US006325160B1

(12) United States Patent
Goodwin et al.

(10) Patent No.: US 6,325,160 B1
(45) Date of Patent: Dec. 4, 2001

(54) UNDERSEA DRILLING TEMPLATE RELEASE MECHANISM AND METHOD

(75) Inventors: Michael James Goodwin, Strathmore (AU); David Harold Theiss, Houston, TX (US)

(73) Assignee: Cooper Cameron Corporation, Houston, TX (US)

( * ) Notice: Subject to any disclaimer, the term of this patent is extended or adjusted under 35 U.S.C. 154(b) by 0 days.

(21) Appl. No.: 09/314,042

(22) Filed: May 18, 1999

(30) Foreign Application Priority Data

Jun. 26, 1998 (AU) ..... PP4347

(51) Int. Cl.[7] ..... E21B 7/12

(52) U.S. Cl. ..... 175/10; 166/358; 166/365; 175/7

(58) Field of Search ..... 175/57, 10; 166/358, 166/365

(56) References Cited

U.S. PATENT DOCUMENTS 4,625,804 * 12/1986 Allen, Jr. ..... 175/5
5,379,844 * 1/1995 Glasscock et al. ..... 166/358

FOREIGN PATENT DOCUMENTS

805896-A * 9/1980 (ZA) .

OTHER PUBLICATIONS

Derwent–Acc–No: 1982–13793E; abstract of South Africa patent document 1980–ZA–0005896; 1982.*

* cited by examiner

*Primary Examiner*—David Bagnell
*Assistant Examiner*—John Kreck

(57) ABSTRACT

An undersea drilling template adapted to be lowered onto a seabed by a drillpipe. The template comprises a template base and at least one arm having a releasable clamping assembly for releasably connecting the template to the drillpipe. The clamping assembly is adapted to be clamped to the drillpipe during lowering of the template and release from the drillpipe when the lowering is completed.

21 Claims, 14 Drawing Sheets

UNDERSEA DRILLING TEMPLATE RELEASE MECHANISM AND METHOD

FIELD OF THE INVENTION

The field of this invention relates to an undersea drilling template.

BACKGROUND OF THE INVENTION

Undersea drilling templates are placed adjacent the seabed to provide a stable hole through which drillbits, drillpipes and other undersea drilling equipment are passed into holes drilled into the seabed by drilling platforms seeking oil and gas deposits. The template's main purpose is to stabilize the seabed adjacent the top of the drill hole to avoid collapsing of the wet sand adjacent the hole. The templates are generally a metal annulus having an outer diameter of about 3048 mm (12 ft) and an inner diameter of about 974 mm (38.38").

Templates are lowered to the seabed over distances ranging from 100 meters to 2500 meters by a running tool attached to the drillpipe by a box-pin thread.

When the template has been lowered to the seabed, the tension in the drillpipe is released to allow the running tool to be rotated out of engagement with the template and then pulled to the surface. A drillbit is then attached to the drillpipe and lowered to the seabed where it must be maneuvered into passing through the central hole in the template for drilling to commence.

This can be a very time-consuming process, taking from between 3 hours in shallow depths to up to 24 hours in deep depths. Further, it can be extremely difficult to maneuver the drillbit into alignment with the template hole as it must first pass through various depths of sea. Remote control submarines fitted with video cameras are often used to assist in maneuvering the drillbit into the template hole.

It is an object of the present invention to substantially overcome or at least ameliorate one or more of the prior art deficiencies.

SUMMARY OF THE INVENTION

In a first aspect, the present invention provides an undersea drilling template adapted to be lowered onto a seabed by a drillpipe. The template comprises a template base and at least one arm having a releasable clamping assembly for releasably connecting the template to the drillpipe, wherein the clamping assembly is adapted to be clamped to the drillpipe during lowering of the template and to release from the drillpipe when the lowering is completed.

Preferably, the arm(s) have a first end mounted to the template base and a second end including all or a portion of the clamping assembly.

Preferably, the template includes a pair of V- or U-shaped arms having their free ends pivotally mounted to the template base and a portion of the clamping assembly at their apex or base.

The clamping assembly is desirably adapted to slide along the drillpipe into abutting relationship with a first shoulder provided on the drillpipe for suspending the template base below the first shoulder.

The clamping assembly is preferably adapted to release from the drillpipe when the continued downward travel of the drillpipe, after the template has been lowered onto the seabed at the completion of the template lowering, causes the clamping assembly to contact a second shoulder provided on the drillpipe above the first shoulder.

The clamping assembly preferably includes a pair of part cylindrical portions with external flanges that may be clamped together around the drillpipe by bolts, shear pins or the like. The second upper shoulder preferably includes a downwardly facing frusto-conical portion adapted to fracture the bolts, shear pins or the like after being driven into the cylindrical portions.

In another embodiment, the clamping assembly includes a latching member pivotally mounted to one of the arms and releasably engageable with the other, the latching member being adapted to be pivoted out of engagement from the other arm after the latching member is contacted by the second shoulder. In one form, the latching member includes a striking plate adapted to release the latching member when contacted by a downwardly facing frusto-conical portion comprising the second shoulder.

The template base preferably includes an inner substantially central hole and the arms are adapted to pivot away from the hole when released so as to provide the drillbit at the end of the drillpipe with access to the inner hole.

The template base also includes a number of compartments adapted to hold ballast material.

BRIEF DESCRIPTION OF THE DRAWINGS

A preferred embodiment of the invention will now be described, by way of example only, with reference to the accompanying drawings in which.

DETAILED DESCRIPTION OF THE PREFERRED EMBODIMENT

Figure 1:
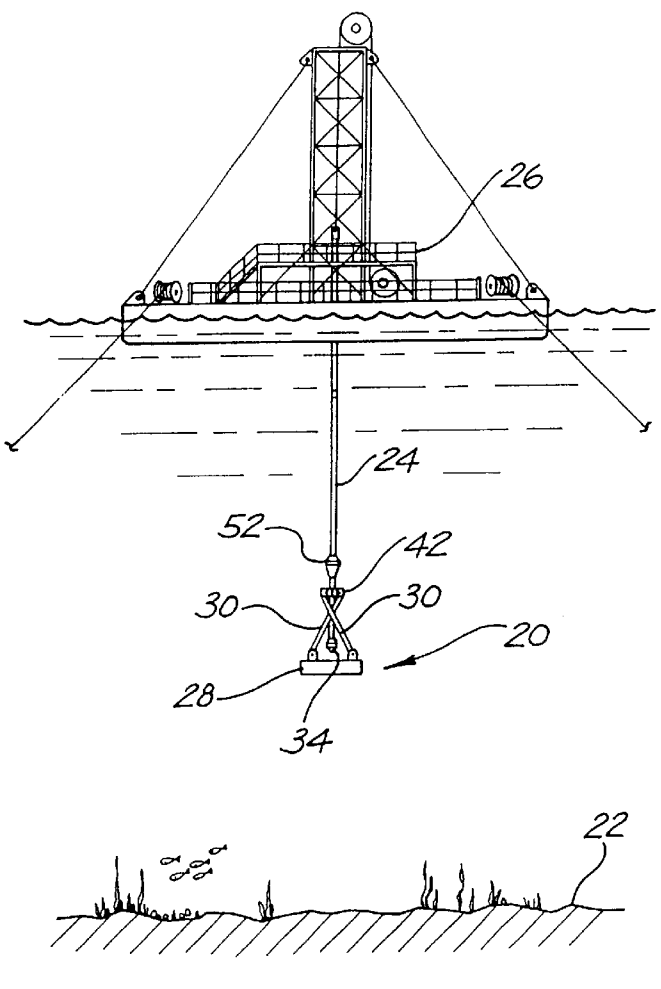
FIG. 1 is a side view of an undersea drilling template according to a first embodiment of the invention being lowered by a drillpipe towards a seabed.
Figure 3:
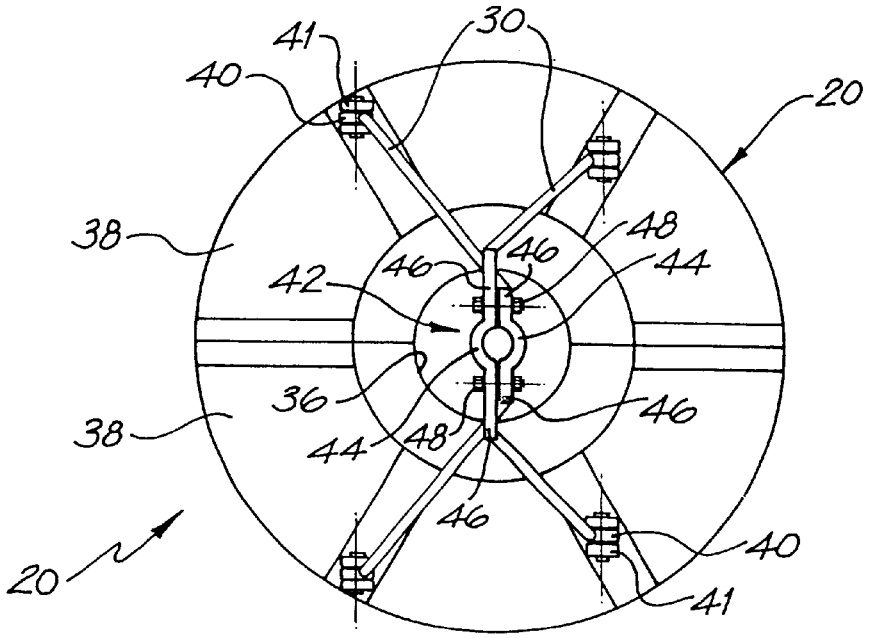
FIG. 3 is a plan view of the template shown in FIG. 1 in the closed configuration shown in FIG. 1.
Figure 4:
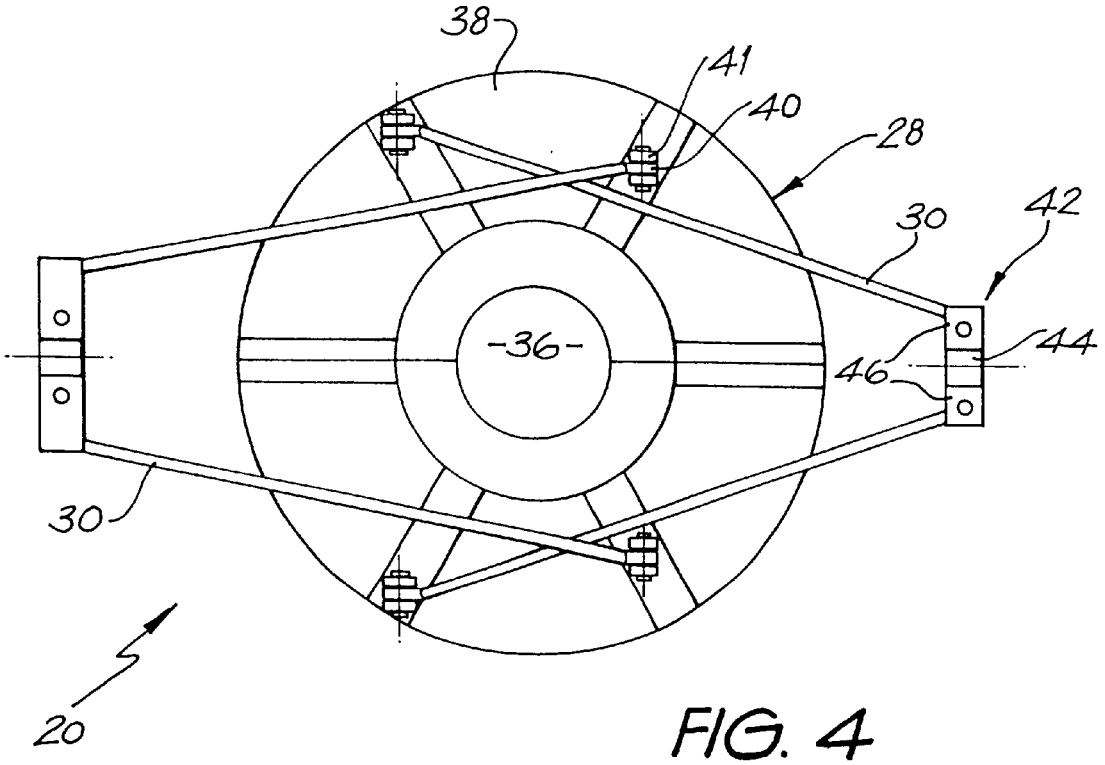
FIG. 4 is a plan view of the template shown in FIG. 1 in an open position as shown in FIG. 2.

FIGS. 1–8 show an undersea template 20 according to a first embodiment of the invention. FIG. 1 shows the template 20 being lowered onto the seabed 22 by a drillpipe 24 extending beneath a drilling platform 26. The template 20 is constructed from steel and comprises a template base 28 and a pair of arms 30 having a releasable clamping assembly 42 for releasably clamping around the drillpipe 24 to releasably connect the template 20 thereto. In FIG. 1, the clamping assembly 42 is shown in a clamped or closed configuration clamping the template 20 to the drillpipe 24 during lowering of the template.

Figure 2:
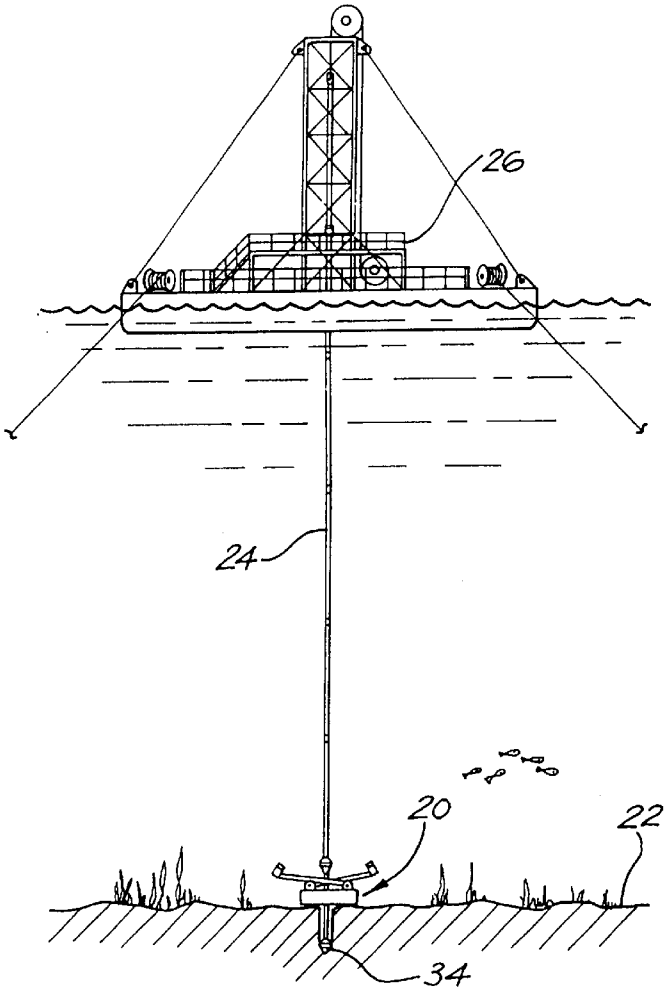
FIG. 2 is a side view of the template shown in FIG. 1 after it has been lowered to the seabed.

FIG. 2 shows the clamping assembly 42 in a released or open configuration releasing the template 20 from the drillpipe 24 after the template 20 h as been lowered to the seabed 22.

As both FIGS. 1 and 2 show, drillbit 34 of the drillpipe 24 is positioned just above the template 20 when it reaches the seabed 22 and can thus continue on through the template 20 and into the seabed 22 without the need to retract the drillpipe, attach the drillbit and thereafter relower the drillpipe and maneuver the drillbit through the template. This represents a significant time, effort and cost-saving compared to the drillpipe retraction and relowering required for prior art templates.

Referring to FIGS. 3–6, the template 20 is of metal annular construction, having an inner opening 36 through which the drillbit 34 and the drillpipe 24 pass during drilling. The template 20 also includes a number of compartments 38 into which ballast material can be introduced in varying amounts to suit the geology of the seabed and to resist guideline tension and environmental loads.

The arms 30 are substantially U-shaped and are hinged at ends 40 to brackets 41 attached to the template base 28. The apex of the arms each include one part of the two-part clamping assembly 42, comprising an hemispherical collar 44 bounded by two outer flanges 46. Bolts 48 pass between the flanges 46 to bolt the clamping assembly 42 in the closed configuration shown in FIG. 3 around the drillpipe 24. Shear pins or other fasteners can, of course, be used in place of the bolts 48.

Figure 5:
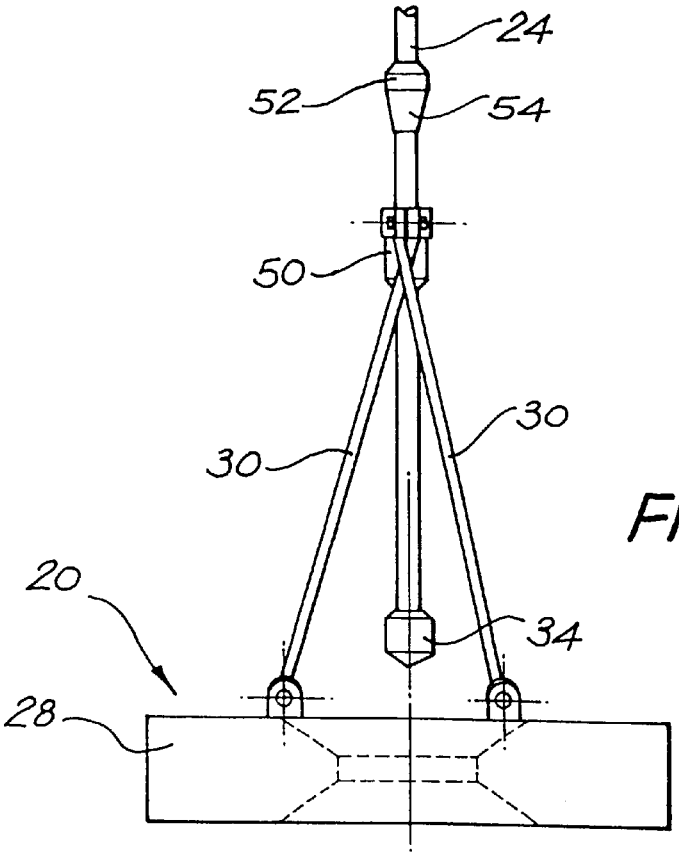
FIG. 5 is a detailed view of the template as shown in FIG. 1.

As best shown in FIG. 5, the drillpipe 24 includes a first shoulder 50 against which the clamping assembly 42 abuts to suspend the template 20 from the drillpipe 24.

Figure 6:
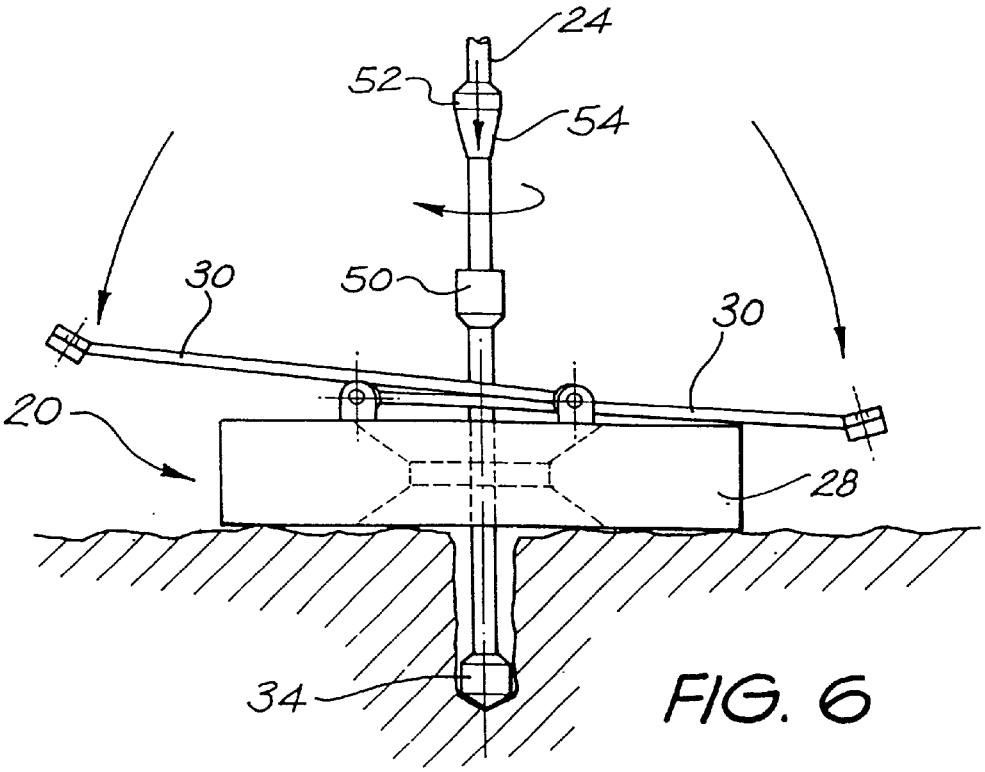
FIG. 6 is a detailed view of the template shown in FIG. 6.
Figure 7:
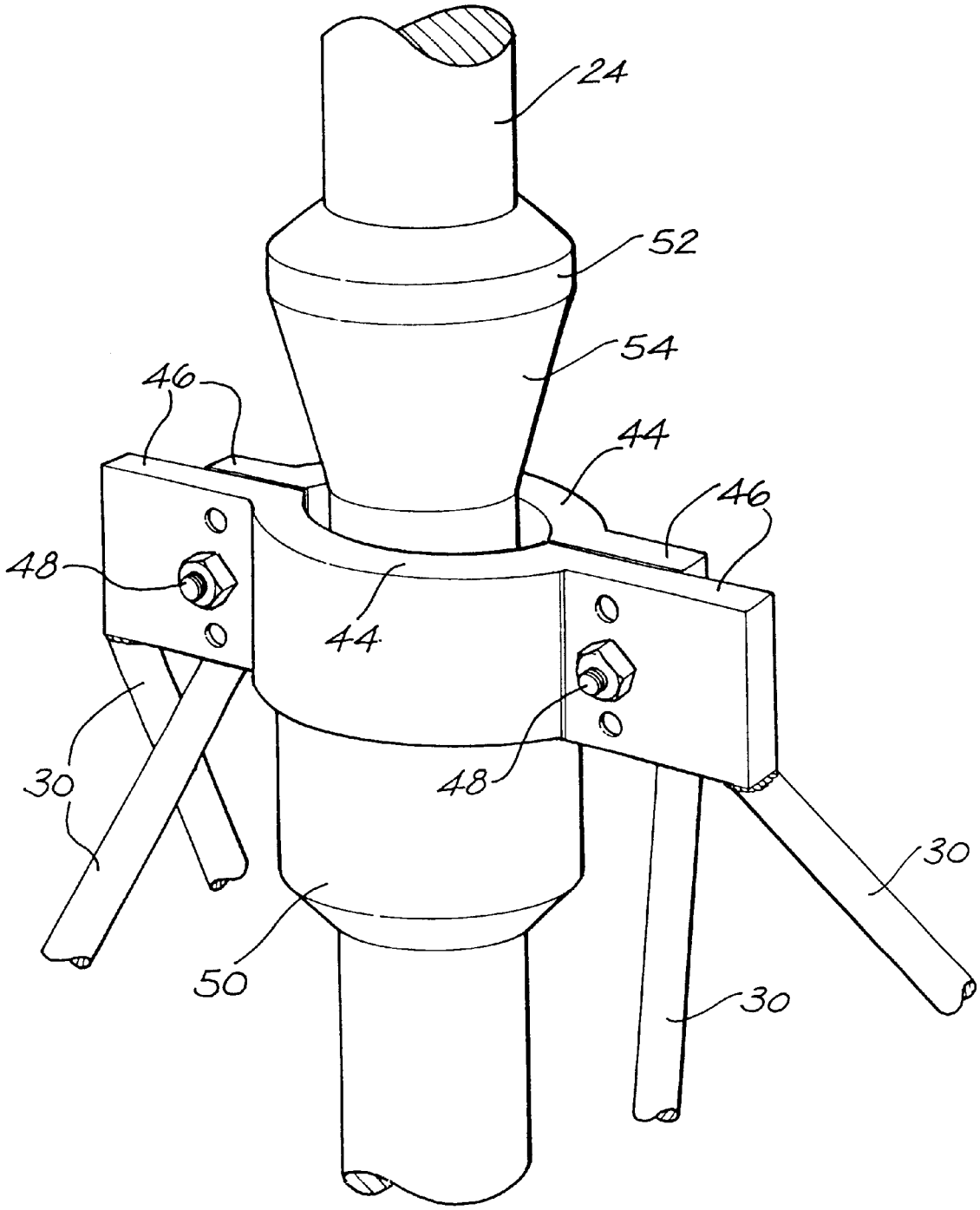
FIG. 7 is a partial close-up view of the template of FIG. 1.
Figure 8:
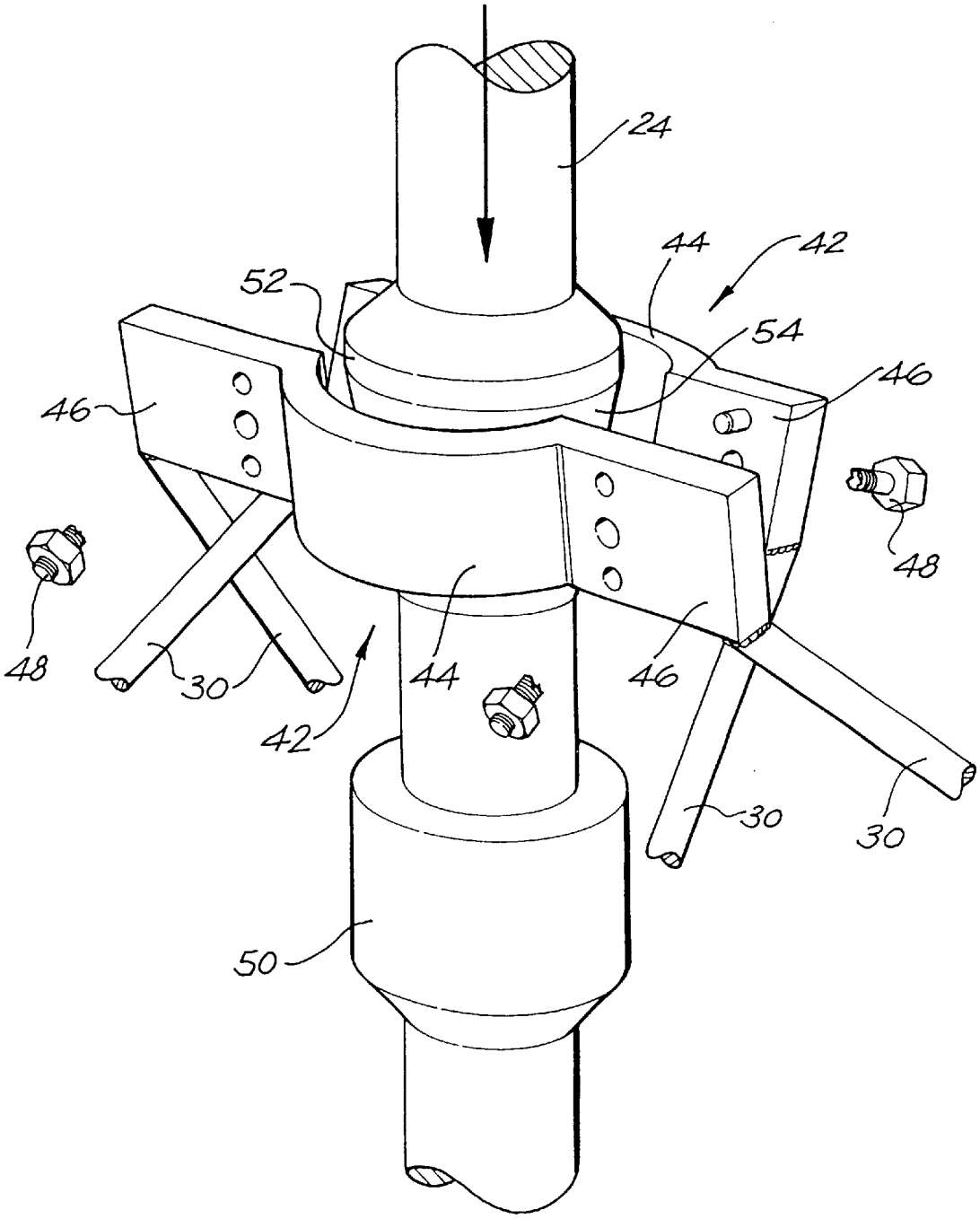
FIG. 8 is a partial detailed close-up view of the template of FIG. 1 during release of the clamping assembly.
Figure 9:
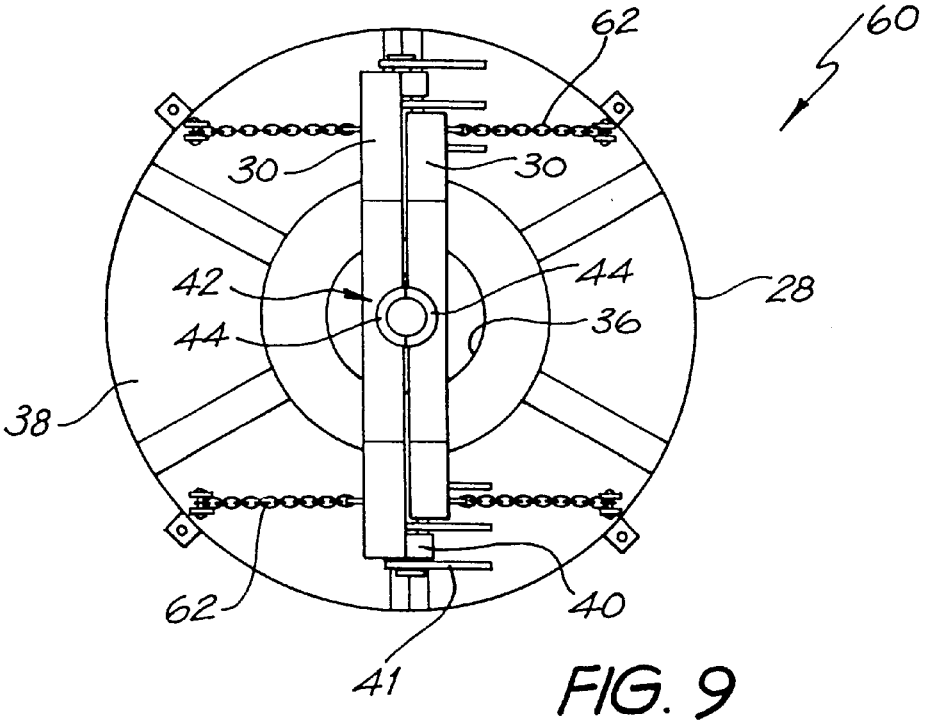
FIG. 9 is a plan view of a template according to a second embodiment of the invention in the clamped position.
Figure 10:
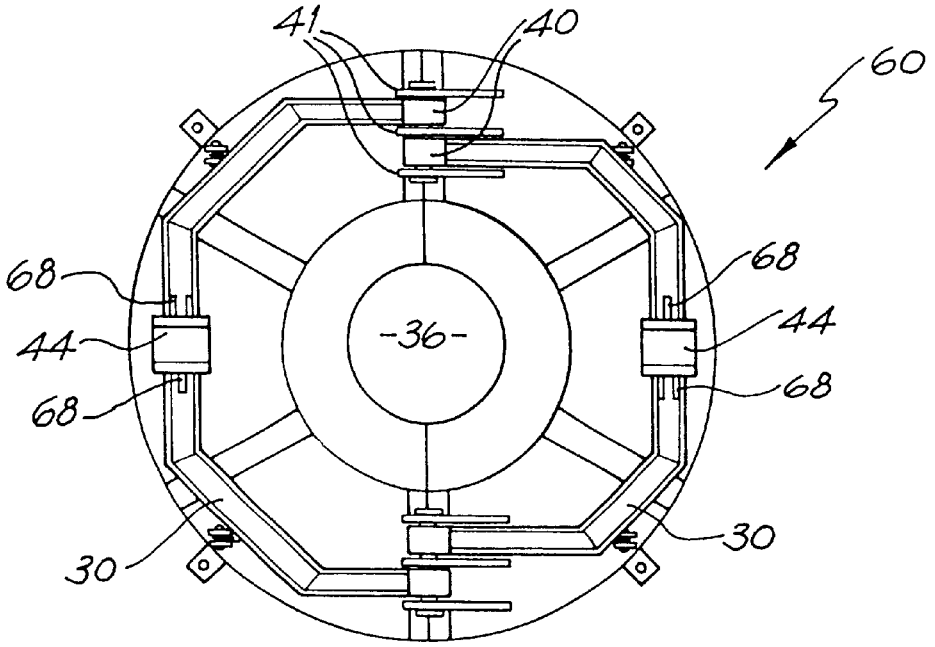
FIG. 10 is a plan view of the embodiment of FIG. 9 in an open position.
Figure 11:
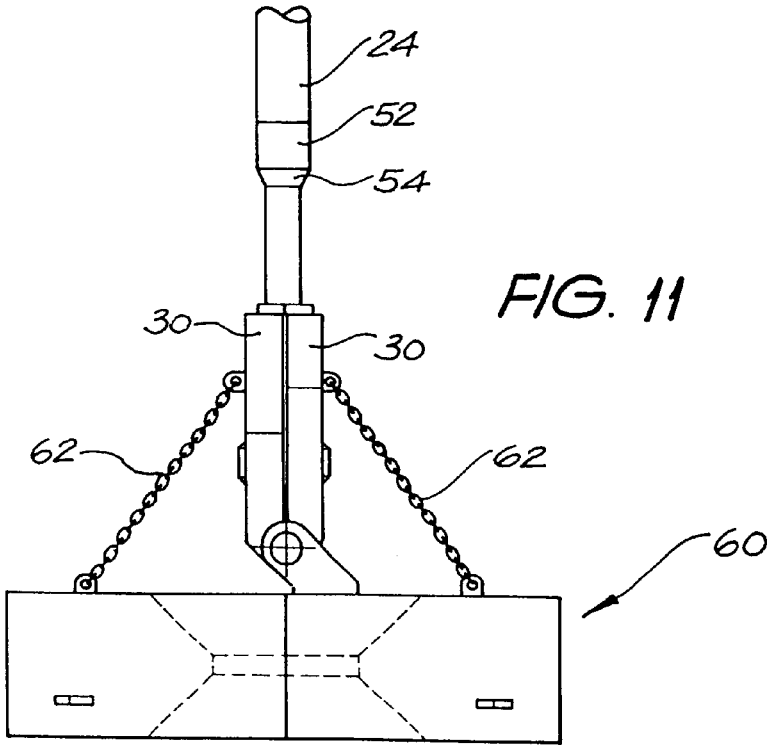
FIG. 11 is a partial side view of the second embodiment in a closed position during lowering.
Figure 12:
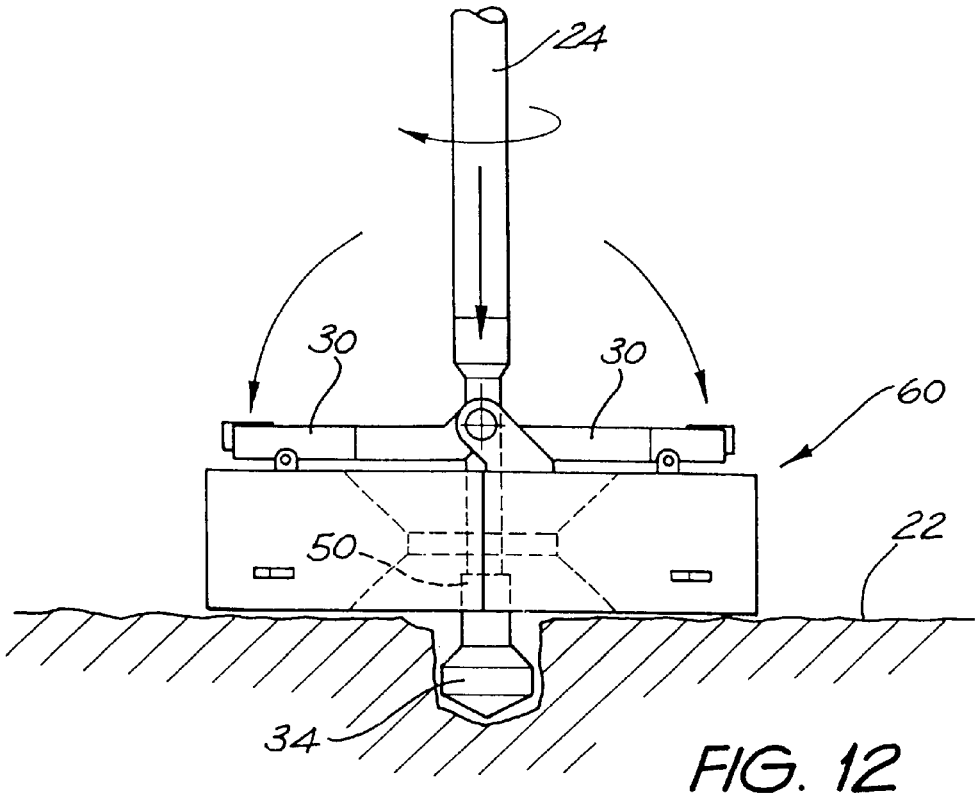
FIG. 12 is a side view of the embodiment of FIG. 9 in the open position after lowering.
Figure 13:
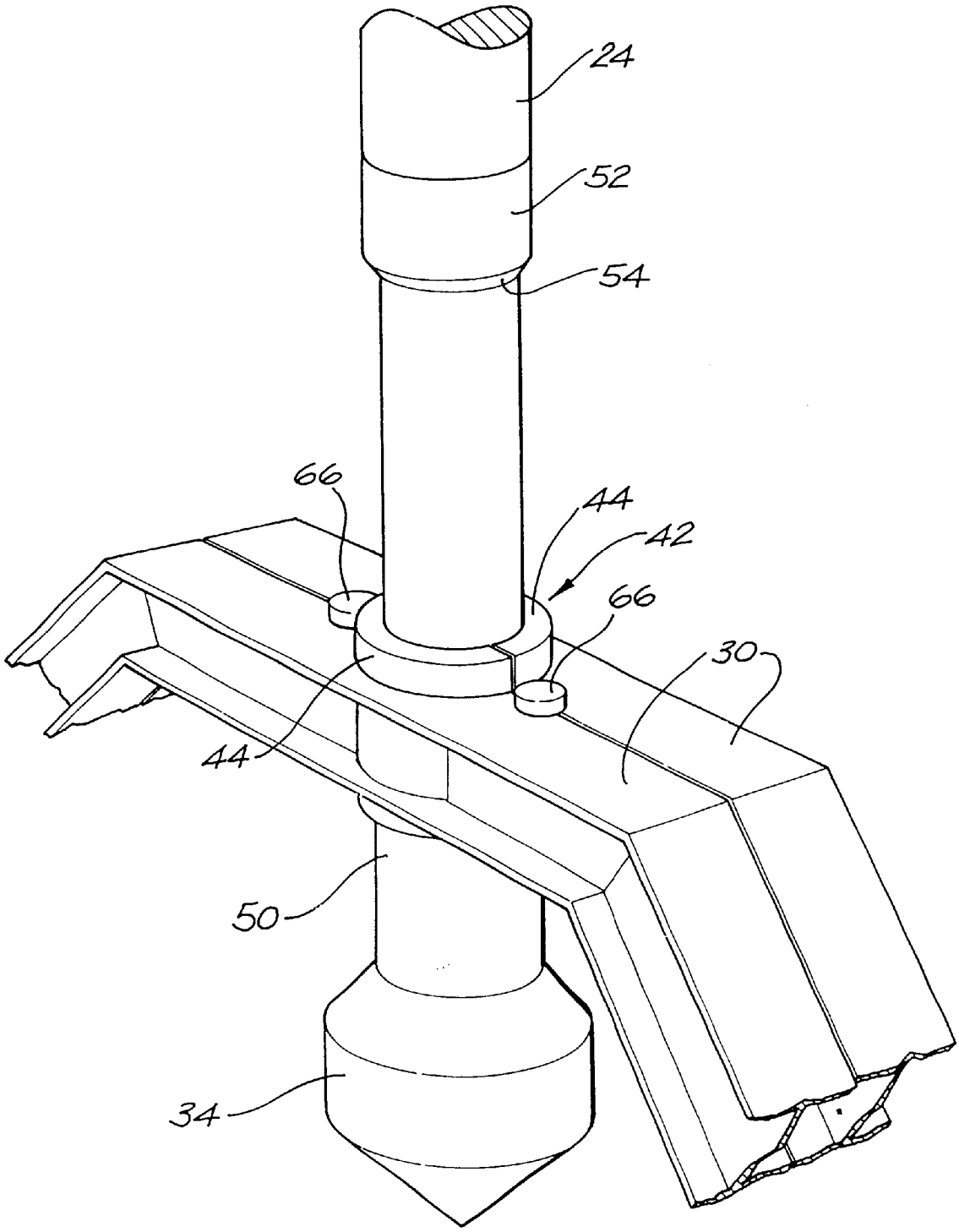
FIG. 13 is a partial detailed view of the embodiment of FIG. 9 during lowering.
Figure 14:
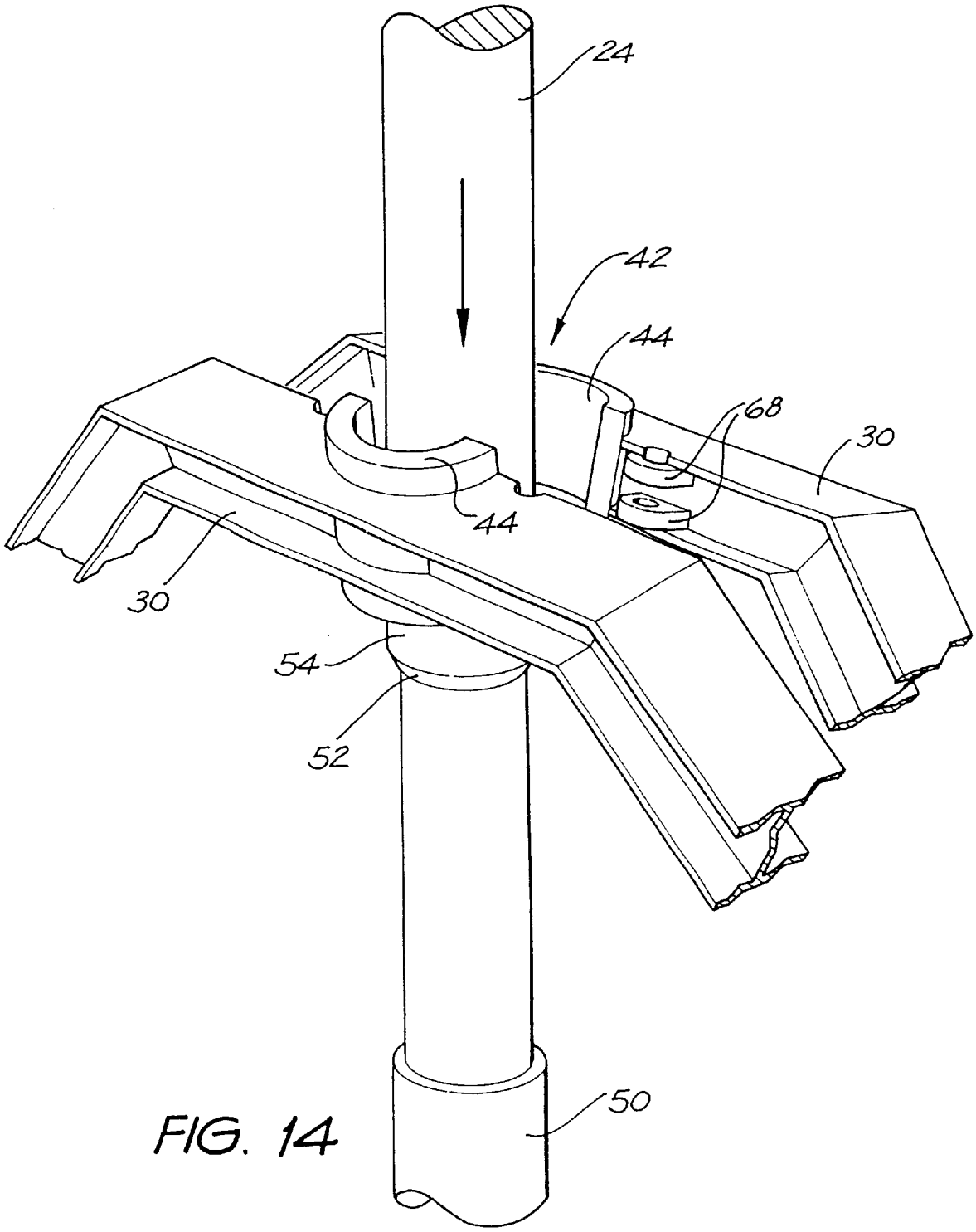
FIG. 14 is a partial detailed view of the embodiment of FIG. 9 during initial release of the clamping means.
Figure 16:
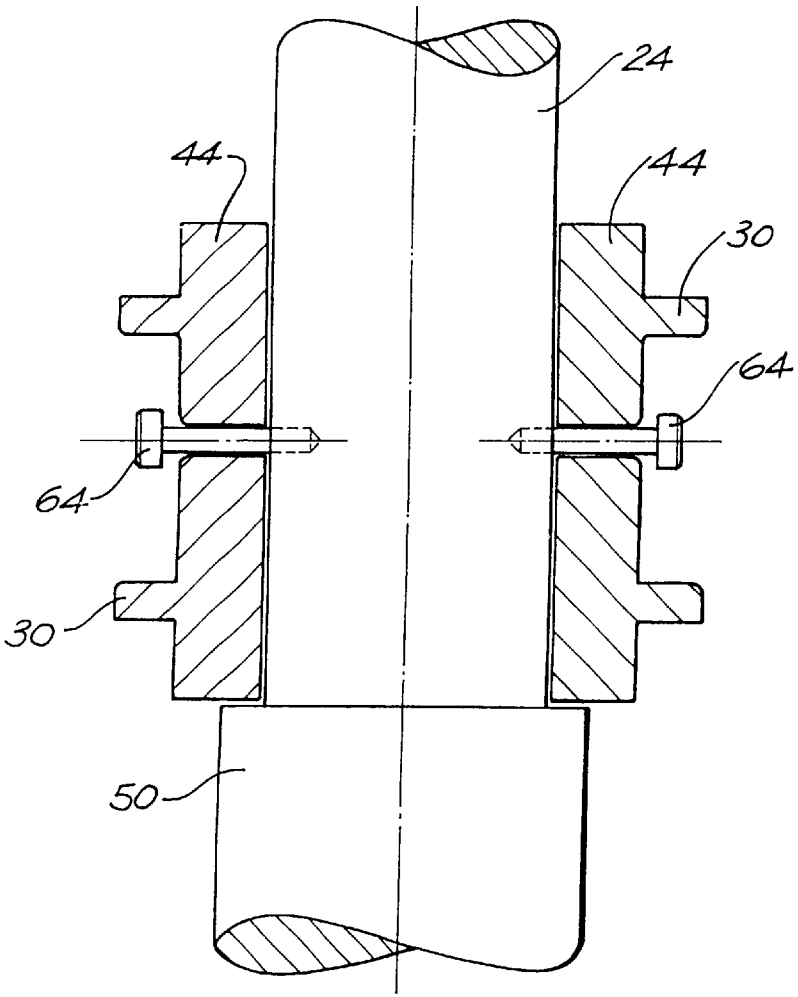
FIG. 16 is a cross-sectional view of the clamping means of FIG. 15 oriented through 90°.

The drillpipe 24 also includes a second shoulder 52 having a downwardly facing frusto-conical portion 54. When the template 20 reaches the seabed 22, the drillpipe 24 continues its downward motion and the frustoconical portion 54 is driven into contact with the clamping assembly 42 and fractures the bolts 48 (see FIG. 8). This releases the clamping assembly 42 and causes the arms 30 to fall into the open configuration and disconnect the template 20 from the drillpipe 24. The arms 30 fall towards the exterior of the template 20 to provide the drillbit 34 with access to the inner opening 36 of the template. Further downward travel of the drillpipe 234 progresses the drillbit 34 through the seabed 22, as shown in FIG. 6.

A template 60 according to a second embodiment of the invention is shown in FIGS. 9–19. Like reference numerals to those used in describing the first embodiment will be used to denote like features with relation to the second embodiment.

The template 60 includes chains 62 between the template 60 and the arms 30 to prevent tipping of the template 60 by supporting the template 60 in an orientation perpendicular to the drillpipe 24 during lowering to the seabed 22.

Figure 15:
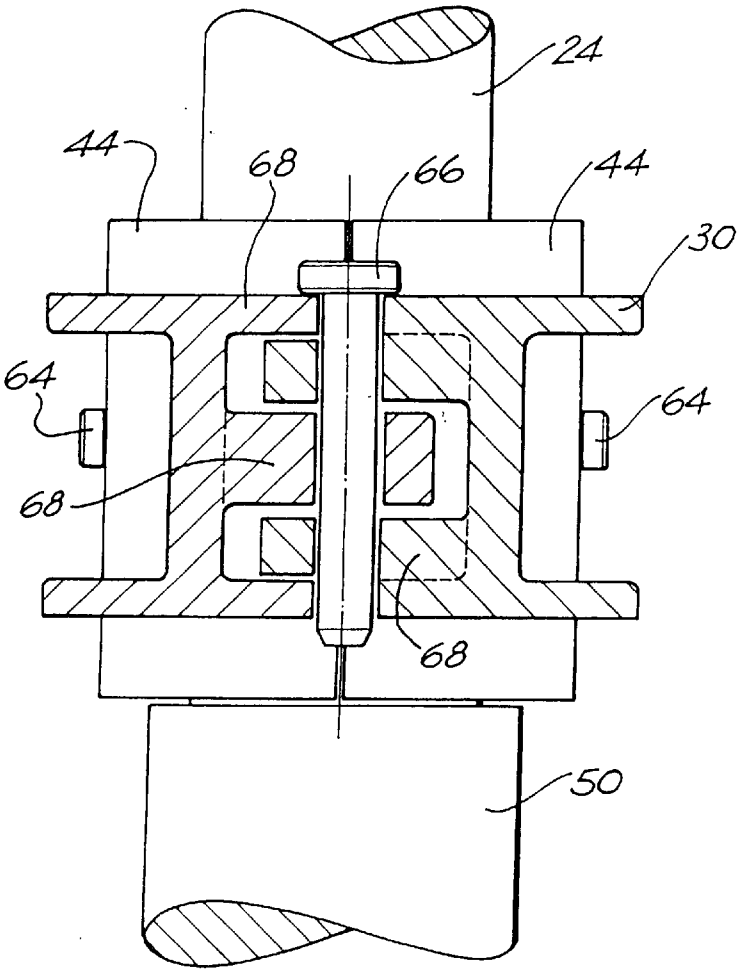
FIG. 15 is a cross-sectional view of the clamping means of FIG. 9.
Figure 18:
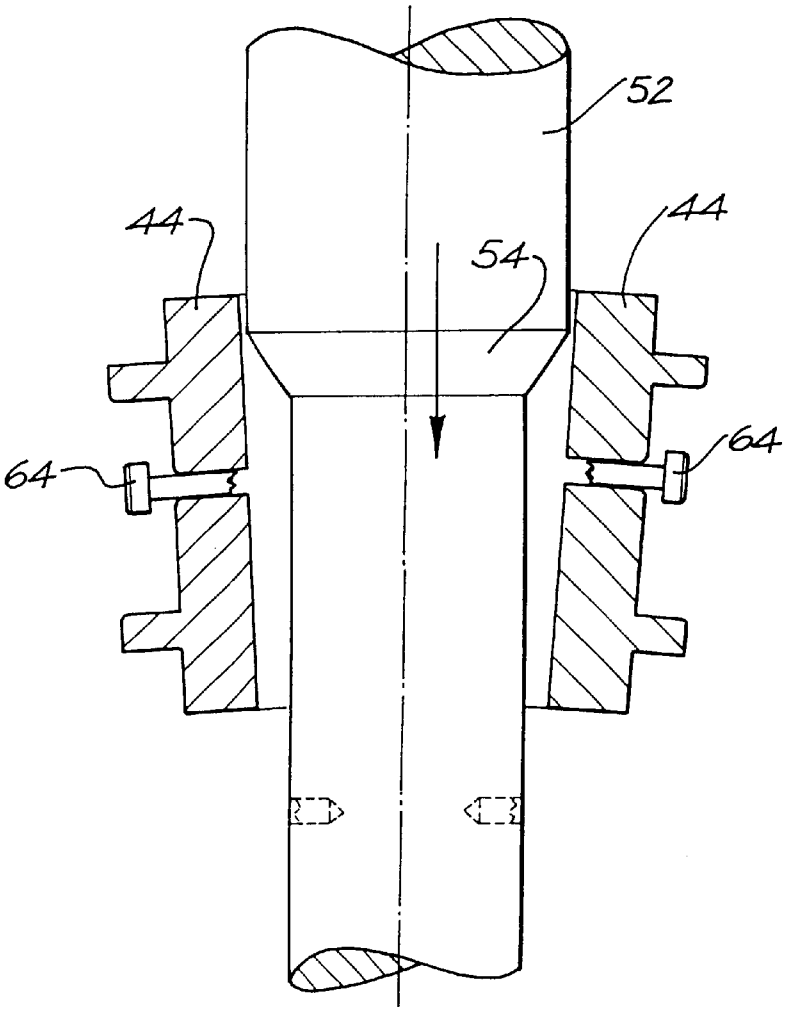
FIG. 18 is a cross-sectional view of the clamping means of FIG. 16 during further release.
Figure 17:
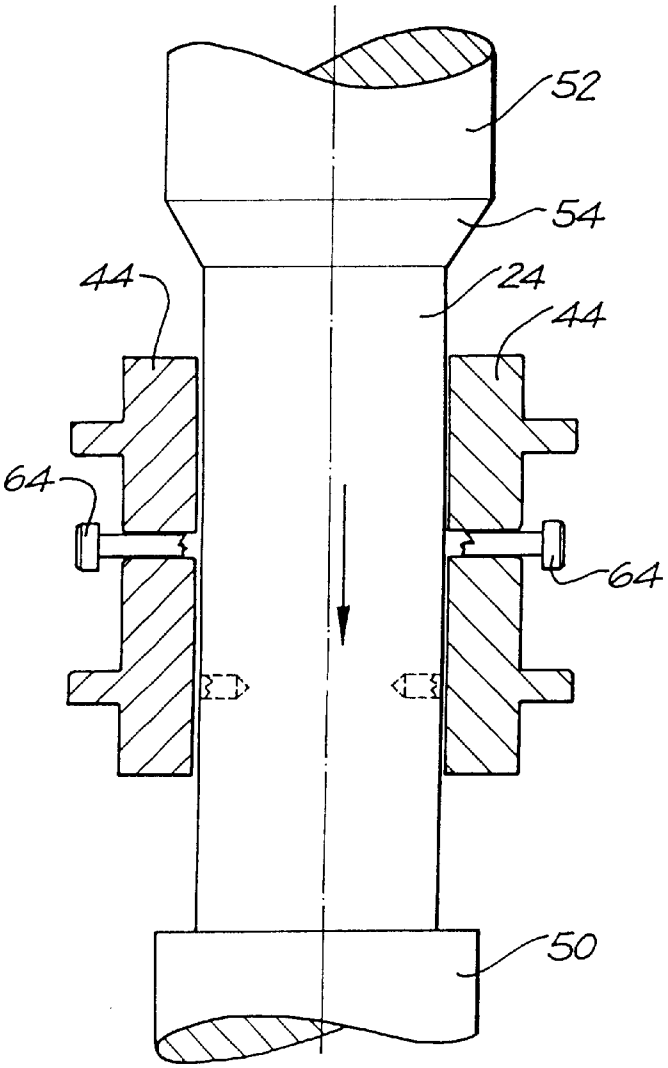
FIG. 17 is a cross-sectional view of the clamping means of FIG. 16 during initial release.
Figure 19:
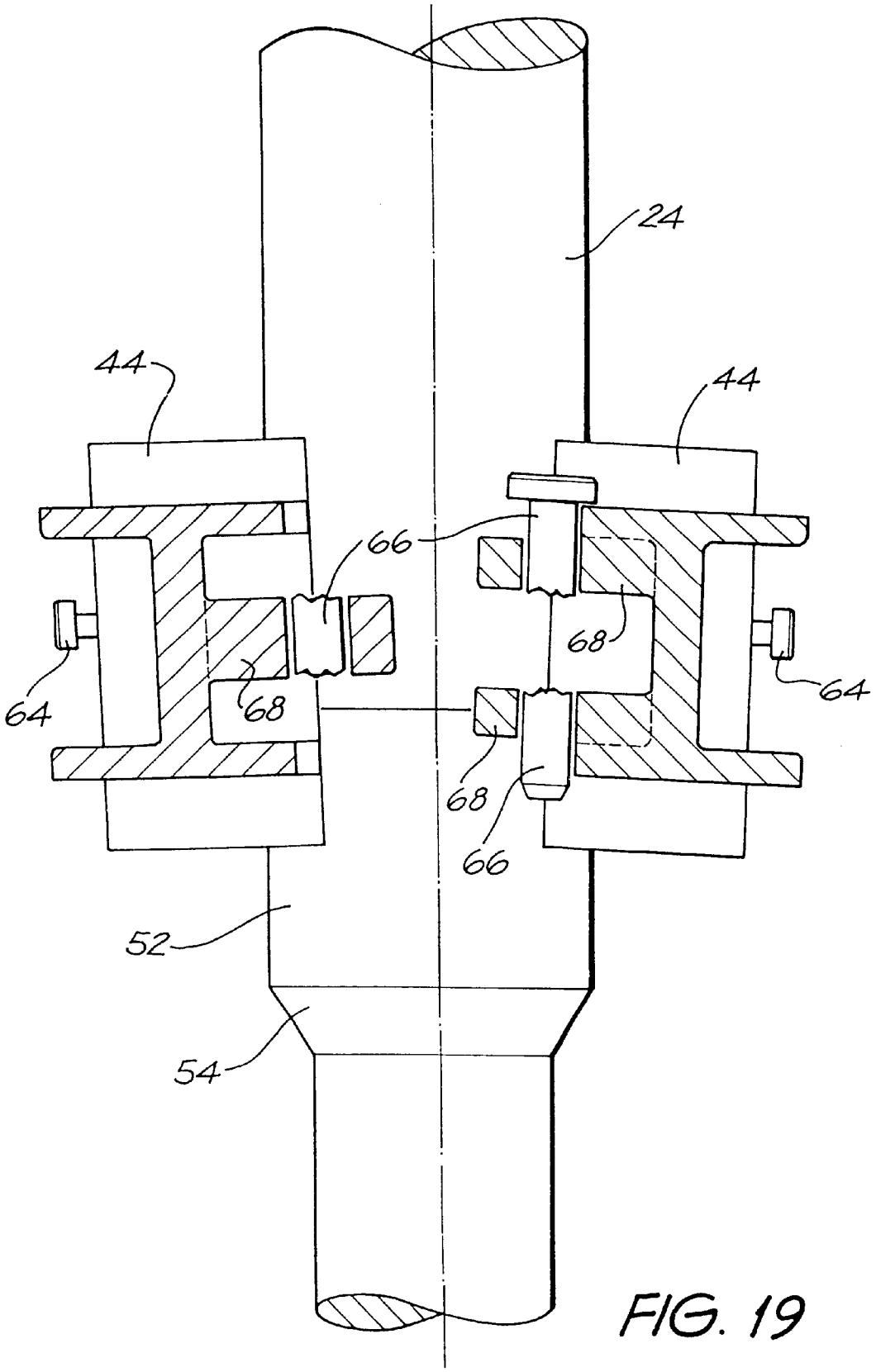
FIG. 19 is a cross-sectional view of the clamping means of FIG. 15 during further release.

As best seen in FIG. 15, the arms 30 are manufactured from steel beams having an I-shaped cross-section and are held in the closed configuration adjacent the drillpipe 24 by shear pins 66 inserted through complementary flanges 68 provided on each of the arms 30 adjacent the hemispherical collars 44. Smaller shear pins 64 also assist in holding the arms 30 in the closed position.

As with the first embodiment, the clamping assembly 42 abuts against the first shoulder 50 of the drillpipe 24 during lowering and, after lowering, the second shoulder 52 continues its downward motion to contact and fracture the small shear pins 64 and then drive the two portions of the clamping assembly 42 apart by fracturing the larger shear pins 66. This process is exemplified in FIGS. 17–19. As with the first embodiment, the two arms 30 fall towards the exterior of the template 60 to provide the drillbit 34 with access to the inner opening 36 of the template 60.

Figure 21:
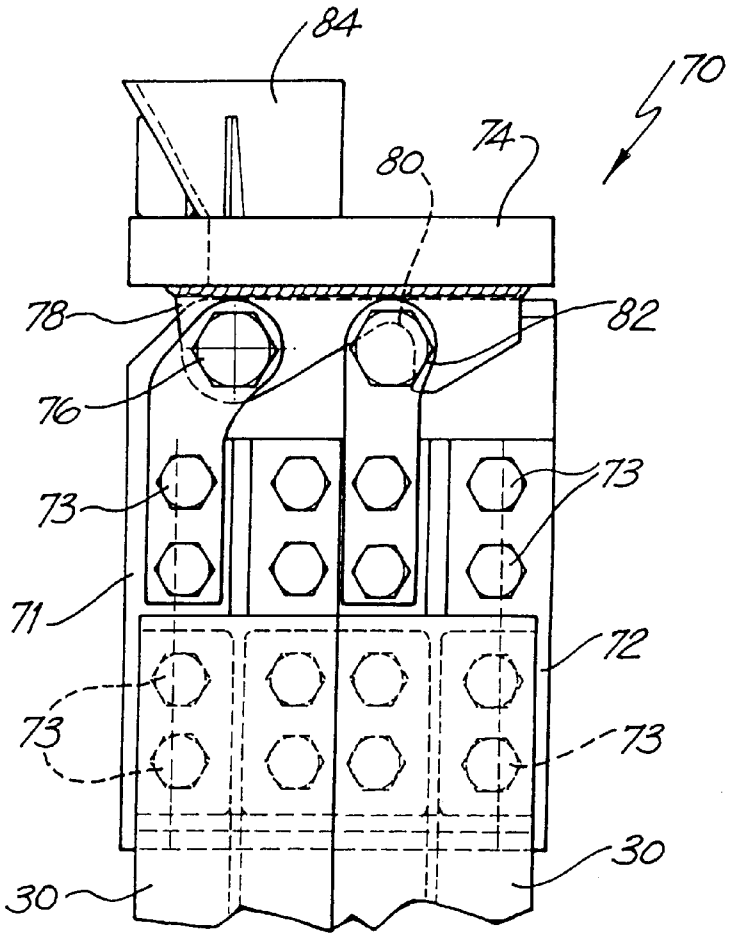
FIG. 21 is a partial side view of the clamping assembly shown in FIG. 20 in the closed configuration.
Figure 20:
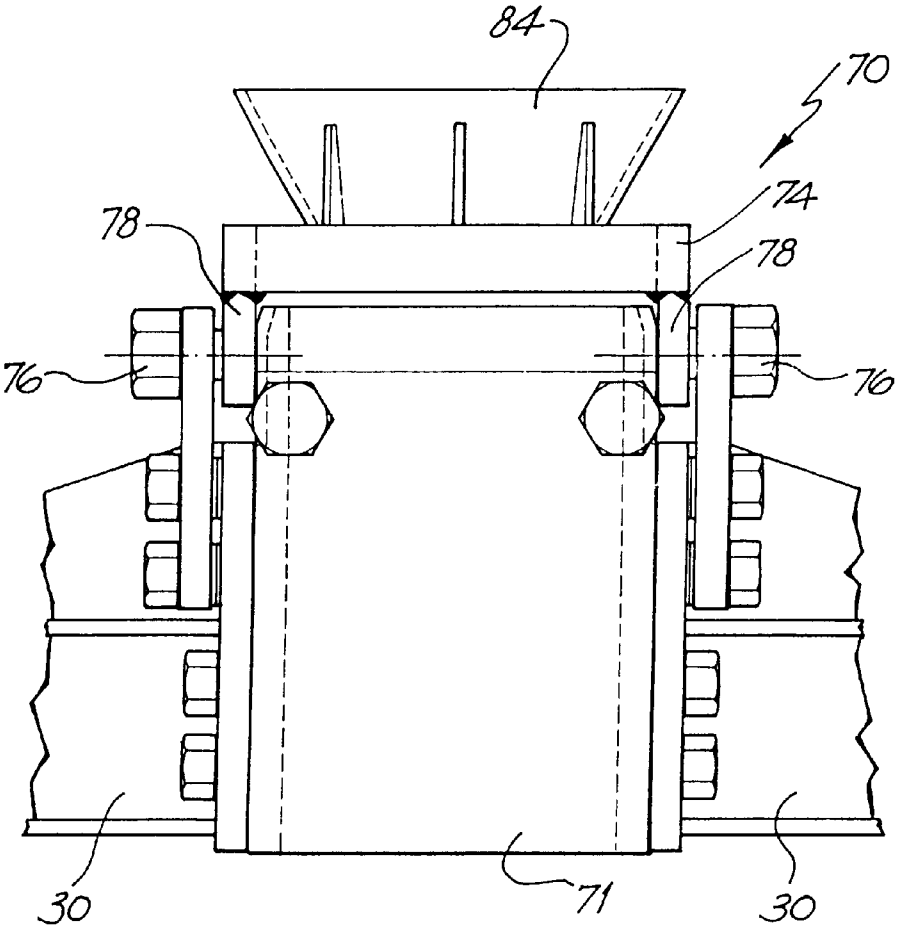
FIG. 20 is a partial rear view of a clamping assembly according to a third embodiment of the invention in a closed configuration.
Figure 22:
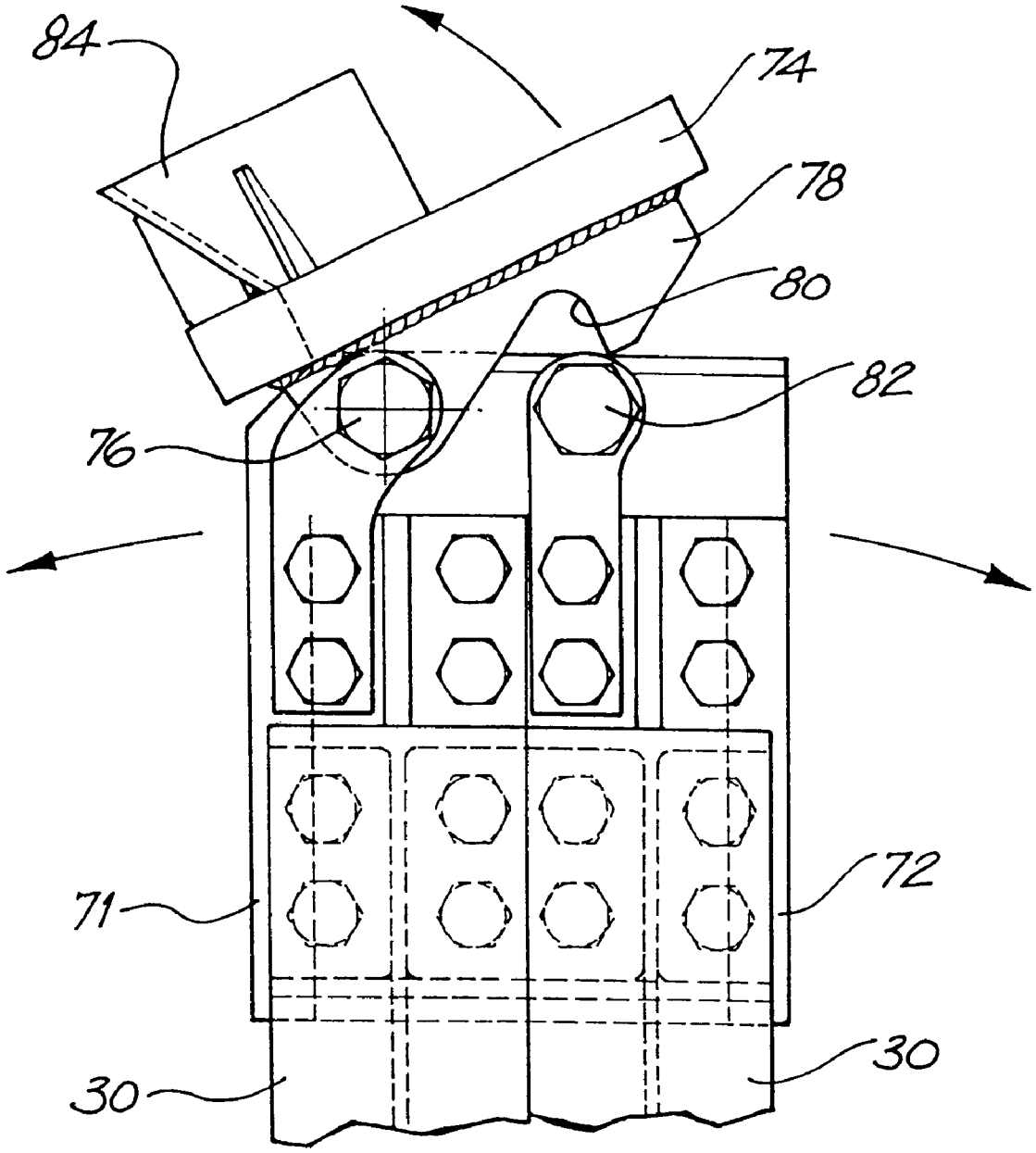
FIG. 22 is a partial side view of the clamping assembly shown in FIG. 20 in open configuration.

A clamping assembly 70 of a third embodiment of the invention is shown in FIGS. 20–22. Uke reference numerals to those used in describing the first embodiment will also be used to denote like features with relation to the third embodiment.

The clamping assembly 70 includes first and second hemispherical collars 71 and 72, respectively, mounted to the apex of each of the arms 30 by bolts 73. A latching member 74 is pivotally mounted to the first collar 72 by bolts 76 passing through a pair of lower flanges 78. The flanges 78 also each include a cutout 80 adapted to engage bolts 82 in the second collar 72 when the latching member 74 is in the closed configuration shown in FIG. 21. The latching member 74 also includes a striking plate 84 upwardly and outwardly angled away from the lower flanges 78.

When the template reaches the seabed and the drillpipe continues its downward motion, the second shoulder is driven into contact with the striking plate 84, which causes the latching member 74 to pivot away from the second collar 72 and release the lower flanges 78 from engagement with the bolts 82. The arms 30 then fall away towards the exterior of the template and release the template in a manner consistent with the first and second embodiments.

Additional advantages of the third embodiment are that the first and second collars 71, 72 and the latching member 74 can be easily replaced with ones of a different size to cater for drillpipes of varying external diameters and the template can be reused without any component replacement.

The foregoing disclosure and description of the invention are illustrative and explanatory thereof, and various changes in the size, shape and materials, as well as in the details of the illustrated construction, may be made without departing from the spirit of the invention.

What is claimed is:

1. A subsea drillpipe template mounting system, comprising:

a support mounted to a template having an opening thereon, said support having a releasable connection to the drillpipe such that upon lowering said drillpipe relatively with respect to said template after said template has landed on the seabed, and without raising said drillpipe, said support releases from the drillpipe.

2. A subsea drillpipe template mounting system, comprising:

a support mounted to a template having an opening thereon, said support having a releasable connection to the drillpipe such that upon lowering said template, to the seabed said support releases from the drillpipe;

relative movement between said support and the drillpipe releases said support;

movement of the drillpipe toward said opening releases said support;

a protrusion on the drillpipe which, upon contact with said support, releases said support.

3. The system of claim 2, wherein:

said support further comprises a clamping assembly releasably secured around the drillpipe; and said protrusion disables said clamping assembly.

4. The system of claim 3, wherein:

said clamping assembly comprises at least two components held together by a releasable retainer; and said protrusion disables said retainer.

5. The system of claim 4 wherein:

said retainer further comprises a breakable member designed to release said components upon exertion of a force from said protrusion as the drillpipe is advanced toward said opening.

6. The system of claim 5, wherein:

said breakable member comprises at least one bolt.

7. The system of claim 5, wherein:

said breakable member comprises at least one shear pin.

8. The system of claim 4, wherein:

said retainer further comprises said latch subject to release by a protrusion mounted on the drillpipe.

9. The system of claim 8, wherein:

said latch comprises a pivotally mounted member which holds said components together and renewably releases them when rotated by said drillpipe protrusion.

10. A subsea drillpipe template mounting system, comprising:

a support mounted to a template having an opening thereon, said support having a releasable connection to the drillpipe such that upon lowering said template to the seabed, said support releases from the drillpipe;

said support is pivotally mounted to said template;

said support comprises at least two components which, when pivoted together, are selectively engageable, around the drillpipe, to each other;

whereupon release of said engagement by the drillpipe, said components pivot to allow the drillpipe to be advanced toward said opening.

11. The system of claim 10, wherein:

said components are held together by a breakable member;

said components are forced apart, breaking said breakable member, by movement of the drillpipe toward said template when said template is supported on the seabed.

12. The system of claim 11, wherein:

said components are wedged apart by a tapering segment on the drillpipe.

13. The system of claim 12, wherein:

said components are initially supported by a shoulder on the drillpipe until said template is supported on the seabed.

14. The system of claim 10, wherein:

said components pivot away from the drillpipe by their own weight.

15. The system of claim 10, wherein:

said components pivot away from each other by virtue of a force applied to them from the drillpipe.

16. A method of initiating a well bore sub-sea, comprising:

running in a drill string which supports a template:

supporting the template sub-sea;

advancing said drill string towards said template, with said template supported;

releasing the template from the drill string, due to said advancing; and effecting said release without moving said drill string away from the template.

17. A method of initiating a wellbore subsea, comprising:

running in a drillstring which supports a template;

supporting the template subsea;

supporting said template with at least two components which are releasably engageable to each other around said drillstring;

releasing the template from the drillstring;

advancing said drillstring, with said template supported to effect said release;

using the drillstring to effect separation of said components.

18. The method of claim 17, further comprising:

using a latch to selectively hold said components to the drillstring.

19. The method of claim 17, further comprising:

using a breakable member to hold said components to the drillstring.

20. The method of claim 19, further comprising:

using a wedge on the drillstring to separate said components.

21. The method of claim 20, further comprising:

allowing said components to swing away from an opening in said template; and advancing the drillstring through said opening.

* * * * *